US008376516B2

(12) United States Patent
Viturro et al.

(10) Patent No.: US 8,376,516 B2
(45) Date of Patent: Feb. 19, 2013

(54) SYSTEM AND METHOD FOR OPERATING A WEB PRINTING SYSTEM TO COMPENSATE FOR DIMENSIONAL CHANGES IN THE WEB

(75) Inventors: R. Enrique Viturro, Rochester, NY (US); Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 12/754,867

(22) Filed: Apr. 6, 2010

(65) Prior Publication Data

US 2011/0243636 A1 Oct. 6, 2011

(51) Int. Cl.
*B41J 2/21* (2006.01)

(52) U.S. Cl. ..... 347/43; 347/13; 346/46

(58) Field of Classification Search ..... 242/57.1; 347/43, 5, 19, 9, 13, 14; 428/292.1; 346/46
See application file for complete search history.

(56) References Cited

U.S. PATENT DOCUMENTS

| | | | | |
|---|---|---|---|---|
| 4,401,024 | A | | 8/1983 | Frentress |
| 4,675,696 | A | * | 6/1987 | Suzuki ..... 346/46 |
| RE32,967 | E | * | 6/1989 | St. John et al. ..... 242/534.1 |
| 4,887,530 | A | | 12/1989 | Sainio |
| 5,325,159 | A | | 6/1994 | Day |
| 5,343,231 | A | | 8/1994 | Suzuki |
| 5,451,990 | A | | 9/1995 | Sorenson et al. |
| 5,539,498 | A | | 7/1996 | De Cock et al. |
| 5,600,350 | A | | 2/1997 | Cobbs et al. |
| 5,796,414 | A | | 8/1998 | Sievert et al. |
| 5,887,236 | A | | 3/1999 | Hirao et al. |
| 5,992,973 | A | * | 11/1999 | Wen ..... 347/43 |
| 6,049,680 | A | | 4/2000 | Goris et al. |
| 6,072,587 | A | | 6/2000 | Hicks |
| 6,076,915 | A | | 6/2000 | Gast et al. |
| 6,089,693 | A | | 7/2000 | Drake et al. |
| 6,109,722 | A | | 8/2000 | Underwood et al. |
| 6,196,652 | B1 | | 3/2001 | Subirada et al. |
| 6,266,437 | B1 | | 7/2001 | Eichel et al. |
| 6,275,600 | B1 | | 8/2001 | Banker et al. |
| 6,300,968 | B1 | | 10/2001 | Kerxhalli et al. |
| 6,334,720 | B1 | | 1/2002 | Kato et al. |
| 6,352,331 | B1 | | 3/2002 | Armijo et al. |
| 6,377,758 | B1 | | 4/2002 | OuYang et al. |
| 6,467,867 | B1 | | 10/2002 | Worthington et al. |
| 6,494,558 | B1 | | 12/2002 | Doval et al. |
| 6,554,390 | B2 | | 4/2003 | Arquilevich et al. |
| 6,637,853 | B1 | | 10/2003 | Ahne et al. |

(Continued)

FOREIGN PATENT DOCUMENTS

EP 0 895 869 A2 2/1999

OTHER PUBLICATIONS

Office Action for U.S. Appl. No. 12/754,730, mailed Jun. 6, 2012, United States Patent and Trademark Office (9 pages).

(Continued)

*Primary Examiner* — Lam S Nguyen
(74) *Attorney, Agent, or Firm* — Maginot, Moore & Beck, LLP

(57) ABSTRACT

A method enables changes in the operation of a web printing system in response to web dimensional changes being detected. The method includes identifying a cross-process dimensional change in a web moving through a printing system, comparing the identified cross-process dimensional change to a predetermined threshold, and changing operation of a component in the web printing system in response to the cross-process dimensional change exceeding the predetermined threshold.

10 Claims, 6 Drawing Sheets

U.S. PATENT DOCUMENTS

| | | | |
|---|---|---|---|
| 6,639,669 | B2 | 10/2003 | Hubble, III et al. |
| 6,655,771 | B2 | 12/2003 | Matsumoto et al. |
| 6,847,465 | B1 | 1/2005 | Wetchler et al. |
| 6,883,892 | B2 | 4/2005 | Sievert et al. |
| 6,942,313 | B2 | 9/2005 | Kanda |
| 6,993,275 | B2 | 1/2006 | Mitsuya et al. |
| 7,073,883 | B2 | 7/2006 | Billow |
| 7,118,188 | B2 | 10/2006 | Vilanova et al. |
| 7,216,948 | B2 | 5/2007 | Matsuzaki et al. |
| 7,254,254 | B2 | 8/2007 | Ueda et al. |
| 7,309,118 | B2 | 12/2007 | Mizes et al. |
| 7,380,897 | B2 | 6/2008 | Anderson et al. |
| 7,390,073 | B2 | 6/2008 | Bailey et al. |
| 7,391,525 | B2 | 6/2008 | Chapman et al. |
| 7,478,894 | B2 | 1/2009 | Kim et al. |
| 7,515,305 | B2 | 4/2009 | Mizes |
| 7,549,721 | B2 | 6/2009 | Nakano et al. |
| 7,552,986 | B2 | 6/2009 | Mizes et al. |
| 7,584,699 | B2 | 9/2009 | Ford |
| 7,607,752 | B2 | 10/2009 | Childers et al. |
| 7,630,519 | B2 | 12/2009 | Nagarajan |
| 7,630,653 | B2 | 12/2009 | Bonino |
| 7,637,586 | B2 | 12/2009 | Yun |
| 7,647,018 | B2 | 1/2010 | Moore et al. |
| 7,686,298 | B2 | 3/2010 | Fioravanti et al. |
| 2002/0131800 | A1 | 9/2002 | Jacob et al. |
| 2002/0135629 | A1 | 9/2002 | Sarmast et al. |
| 2003/0082360 | A1 * | 5/2003 | O'Donnell et al. ..... 428/292.1 |
| 2003/0231350 | A1 | 12/2003 | Yamagishi |
| 2004/0160468 | A1 | 8/2004 | Kim et al. |
| 2005/0099447 | A1 | 5/2005 | Hsu et al. |
| 2006/0072939 | A1 | 4/2006 | Kremer et al. |
| 2006/0109329 | A1 | 5/2006 | Holtman et al. |
| 2006/0109330 | A1 | 5/2006 | Holtman |
| 2006/0114302 | A1 | 6/2006 | Holtman |
| 2008/0062219 | A1 | 3/2008 | Mizes et al. |
| 2008/0124158 | A1 | 5/2008 | Folkins et al. |
| 2009/0265950 | A1 | 10/2009 | Mizes et al. |
| 2009/0293750 | A1 | 12/2009 | Haenni et al. |
| 2009/0322849 | A1 | 12/2009 | Calamita et al. |
| 2010/0013882 | A1 | 1/2010 | Mizes et al. |
| 2012/0056928 | A1 | 3/2012 | Powers et al. |
| 2012/0155894 | A1 | 6/2012 | Kim et al. |

OTHER PUBLICATIONS

Amendment in Response to Office Action for U.S. Appl. No. 12/754,730, submitted Sep. 5, 2012 (14 pages).

Office Action for U.S. Appl. No. 12/754,735, mailed Jun. 4, 2012, United States Patent and Trademark Office (6 pages).

Amendment in Response to Office Action for U.S. Appl. No. 12/754,735, submitted Aug. 6, 2012 (7 pages).

* cited by examiner

SYSTEM AND METHOD FOR OPERATING A WEB PRINTING SYSTEM TO COMPENSATE FOR DIMENSIONAL CHANGES IN THE WEB

TECHNICAL FIELD

This disclosure relates generally to moving web printing systems, and more particularly, to moving web printing systems that use a reflex system to register images printed by different printheads.

BACKGROUND

A known system for ejecting ink to form images on a moving web of media material is shown in FIG. 6. The system 10 includes a web unwinding unit 14, a paper conditioning unit 16, a media preparation station 18, a pre-heater roller 22, a plurality of marking stations 26, a turn roller 30, a leveling roller 34, and a spreader 38. In brief, the web unwinding unit 14 includes an actuator, such as an electrical motor, that rotates a web of media material in a direction that removes media material from the web. The media material is fed from the unwinding unit 14 through the paper conditioning unit 16 and the media preparation station 18 along a path formed by the pre-heater roller 22, turn roller 30, and leveling roller 34 and then through the spreader 38 to a rewinder 40. The paper conditioning unit includes a heated roller that heats the media to a predetermined temperature to begin media surface preparation. The media preparation station 18 removes debris and loose particulate matter from the web surface to be printed and the pre-heater roller 22 is heated to a temperature that transfers sufficient heat to the media material for optimal ink reception on the web surface as it passes the marking stations 26. Each of the marking stations 26A, 26B, 26C, and 26D in FIG. 6 includes two staggered full width printhead arrays, each of which has three or more printheads that eject ink onto the web surface. The different marking stations eject different colored inks onto the web to form a composite colored image. In one system, the marking stations eject cyan, magenta, yellow, and black ink for forming composite colored images. The surface of the web receiving ink does not encounter a roller until it contacts the leveling roller 34. Leveling roller 34 modifies the temperature of the web and reduces any temperature differences between inked and non-inked portions of the web. After the temperature leveling, the ink is heated by heater 44 before the printed web enters the spreader 38. The spreader 38 applies pressure to the ejected ink on the surface of the web to smooth the roughly semicircular ink drops on the surface of the web and to encourage ink fill with the different colors and present a more uniform image to a viewer. The web material is then wound around the rewinding unit 40 for movement to another system for further processing of the printed web.

This system 10 also includes two load cells, one of which is mounted at a position near pre-heater roller 22 and the other is mounted at a position near the turn roller 30. These load cells generate signals corresponding to the tension on the web proximate the position of the load cell. Each of the rollers 22, 30, and 34 has an encoder mounted near the surface of the roller. These encoders may be mechanical or electronic devices that measure the angular velocity of a roller monitored by the encoder, which generates a signal corresponding to the angular velocity of the roller. In a known manner, the signal corresponding to the angular velocity measured by an encoder is provided to the controller 60, which converts the angular velocity to a linear web velocity. The linear web velocity may also be adjusted by the controller 60 with reference to the tension measurement signals generated by the load cells. The controller 60 may be configured with I/O circuitry, memory, programmed instructions, and other electronic components to implement a double reflex printing system that generates the firing signals for the printheads in the marking stations 26. The term "controller" or "processor" as used in this document refers to a combination of electronic circuitry and software that generate electrical signals to control a portion or all of a process or system.

The system 10 may also include an imaging device 68, such as an image-on-web array (IOWA) sensor, that generates image data corresponding to a portion of the web passing the imaging device. The imaging device 68 may be implemented with a plurality of imaging sensors that are arranged in a single or multiple row array that extends across at least a portion of the web to be printed. The imaging sensors direct light towards the moving web and generate electrical signals having an intensity corresponding to a light reflected off the web. The intensity of the reflected light is dependent upon the amount of light absorbed by the ink on the surface, the light scattered by the web structure, and the light reflected by the ink and web surface. The imaging device 68 is communicatively coupled to the machine controller 60 to enable the image data generated by the imaging device 68 to be received and processed by the controller 60. This image data processing enables the controller to detect the presence and position of ink drops ejected onto the surface of the web at the imaging device 68.

As noted above, the controller 60 uses the tension measurements from the two load cells along with the angular velocity measurements from encoders to compute linear web velocities at the rollers 22, 30, and 34. These linear velocities enable the processor to determine when a web portion printed by one marking station, station 26A, for example, is opposite another marking station, station 26B, for example, so the second marking station can be operated by the controller 60 with firing signals to eject ink of a different color onto the web in proper registration with the ink already placed on the web by a previous marking station. When the subsequent marking station is operated too soon or too late, the ejected ink lands on the web at positions that may produce visual noise in the image. This effect is known as misregistration. Accurate measurements, therefore, are important in registration of different colored images on the web to produce images with little or no visual noise.

One factor affecting the registration of images printed by different groups of printheads is web shrinkage. Web shrinkage is caused as the web is subjected to relatively high temperatures as the web moves along the relatively long path through the web printing system. The high temperatures drive moisture content from the web, which causes the web to shrink. If the physical dimensions of the web change after one group of printheads has formed an image in one color ink, but before another group of printheads has formed an image in another color of ink, then the registration of the two images is affected. The change may be sufficient to cause misregistration between ink patterns ejected by the different groups of printheads. The amount of shrinkage depends upon the heat to which the web is subjected, the speed of the web as it moves over heated components, the moisture content of the paper, and the type of paper. Reducing the effect of web dimensional changes on image registration is a goal in web printing systems.

SUMMARY

A method enables changes in web dimensions to be measured to enable adjustment of the media conditioning and registration control. The method includes identifying a dimensional change in a web moving through a printing system, comparing the identified dimensional change to a predetermined threshold, and changing operation of a component in the web printing system in response to the dimensional change exceeding the predetermined threshold.

A web printing system compensates for dimensional changes in a moving web to avoid misregistration in the images printed onto the moving web. The system includes an imaging device to generate image data of a web passing by the imaging device, a controller associated with the web printing system, the controller being configured to measure a dimensional change in the web with reference to the image data received from the imaging device and to change operation of a component in the web printing system in response to the measured dimensional change exceeding the predetermined threshold.

BRIEF DESCRIPTION OF THE DRAWINGS

The foregoing aspects and other features of a system and method that identifies dimensional changes in a web passing through a web printing system and changes operation of a component in the web printing system in response to the identified dimensional change exceeding a predetermined threshold are explained in the following description, taken in connection with the accompanying drawings.

DETAILED DESCRIPTION

Figure 1:
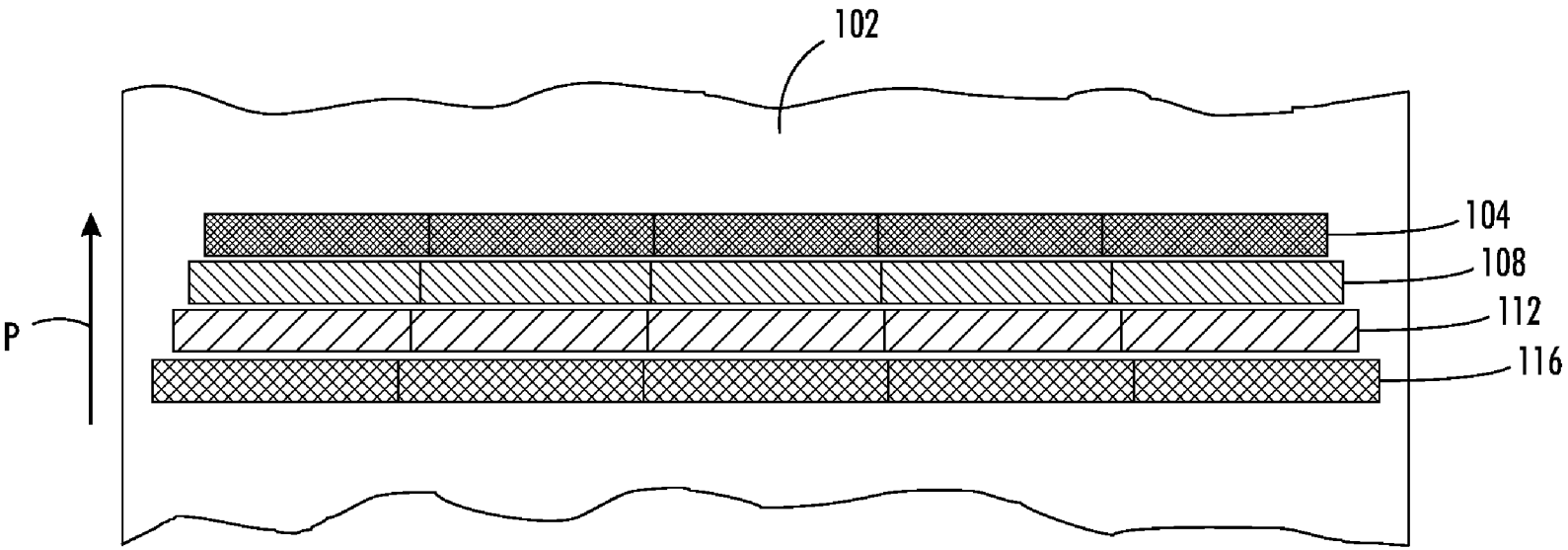
FIG. 1 illustrates a cross-process dimensional change in a web moving through a web printing system.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. Also, the description presented below is directed to a system for operating a printer that forms images on a moving web driven by rollers. Also, the word "component" refers to a device or subsystem in the web printing system that is operated by a controller in the web printing system to condition the web, print the web, or move the web through the web printing system.

In one embodiment of a web printing system that uses a double reflex technique to control the firing of the printheads in the marking stations, the marking stations are solid ink marking stations. Solid ink marking stations use ink that is delivered in solid form to the printer, transported to a melting device where the ink is heated to a melting temperature and converted to liquid ink. The liquid ink is supplied to the printheads in the marking stations and ejected from the printheads onto the moving web in response to firing signals generated by the controller 60. In such a continuous feed direct marking system, the print zone is the portion of the web extending from the first marking station to the last marking station. In some systems, this print zone may be several meters long. If the angular velocity of each encoder mounted proximate to a roller is converted to a linear speed for the web, the variations between the linear web velocities at the different rollers over time can accumulate and lead to misregistration of the images.

At steady state for such a printing system, the average web velocity times the web material mass per length must be equal at all rollers or other non-slip web interface surfaces. Otherwise, the web would either break or go slack. To account for the differences in instantaneous velocities at rollers in or near a print zone, a double reflex processor interpolates between linear web velocities at a pair of rollers, one roller on each side of a marking station with reference to the direction of the moving web, to identify a linear velocity for the web at a position proximate the marking station. This interpolation uses the linear web velocity derived from the angular velocity of a roller placed at a position before the web reaches the marking station and the linear web velocity derived from the angular velocity of a roller placed at a position after the web passes by the marking station along with the relative distances between the marking station and the two rollers. The interpolated value correlates to a linear web velocity at the marking station. A linear web velocity is interpolated for each marking station. The interpolated web velocity at each marking station enables the processor to generate the firing signals for the printheads in each marking station to eject ink as the appropriate portion of the web travels past each marking station. A double reflex control system is described in U.S. Pat. No. 7,665,817, which is entitled "Double Reflex Printing" and which issued on Feb. 23, 2010 and is owned by the assignee of the present application. The disclosure of this patent is expressly incorporated herein by reference in its entirety.

FIG. 1 depicts four patterns 104, 108, 112, and 116 that were printed by four groups of printheads, each group including four printheads that eject ink of a single color onto a web 102 moving the process direction P. Thus, pattern 104 is a different color than the other three patterns and similarly each of the other patterns 108, 112, and 116 are different than the other patterns. As shown in FIG. 1, pattern 104 is magenta, pattern 108 is cyan, pattern 112 is yellow, and pattern 116 is black. Each pattern shown in FIG. 1 includes stitch lines, which have been exaggerated in the figure, to identify the portion of each pattern printed by one of the printheads in the group of printheads that printed the pattern. The cross-process length of each pattern in FIG. 1 is different to illustrate the effect of web shrinkage on the printing of the patterns. Because the magenta pattern was printed first, the web on which it was printed travels further through the printing system after being printed than the portion of the web onto which the black pattern was printed. Consequently, the portion of the web underlying the magenta ink has had longer exposure to heat and an attendant water loss. The water loss may be significant enough to cause web shrinkage. Thus, the cross-process length of the magenta pattern also shrinks. Because the portion of the web underlying the black ink has had less time to shrink following the printing of the black ink pattern, the black pattern 116 is wider. These dimensional differences in the cross-process direction may be sufficient to cause misregistration between ink patterns ejected by the different groups of printheads. For example, in one web printing system, the web was observed to shrink in the cross-process direction by as much as 50 μm over a cross-process distance of 2.9 inches in the distance the web travels between the printing of the magenta pattern and the printing of the black pattern. Thus, in this example, the drops of magenta ink move as a result of this shrinkage. Consequently, when the magenta drops pass underneath the black printhead, the drops of black ink ejected by that printhead now land at positions more distant from the magenta drops than was intended when the image data was rendered. The amount of shrinkage depends upon the heat to which the web is subjected, the speed of the web as it moves over heated components, the moisture content of the paper, and the type of paper.

Figure 2:
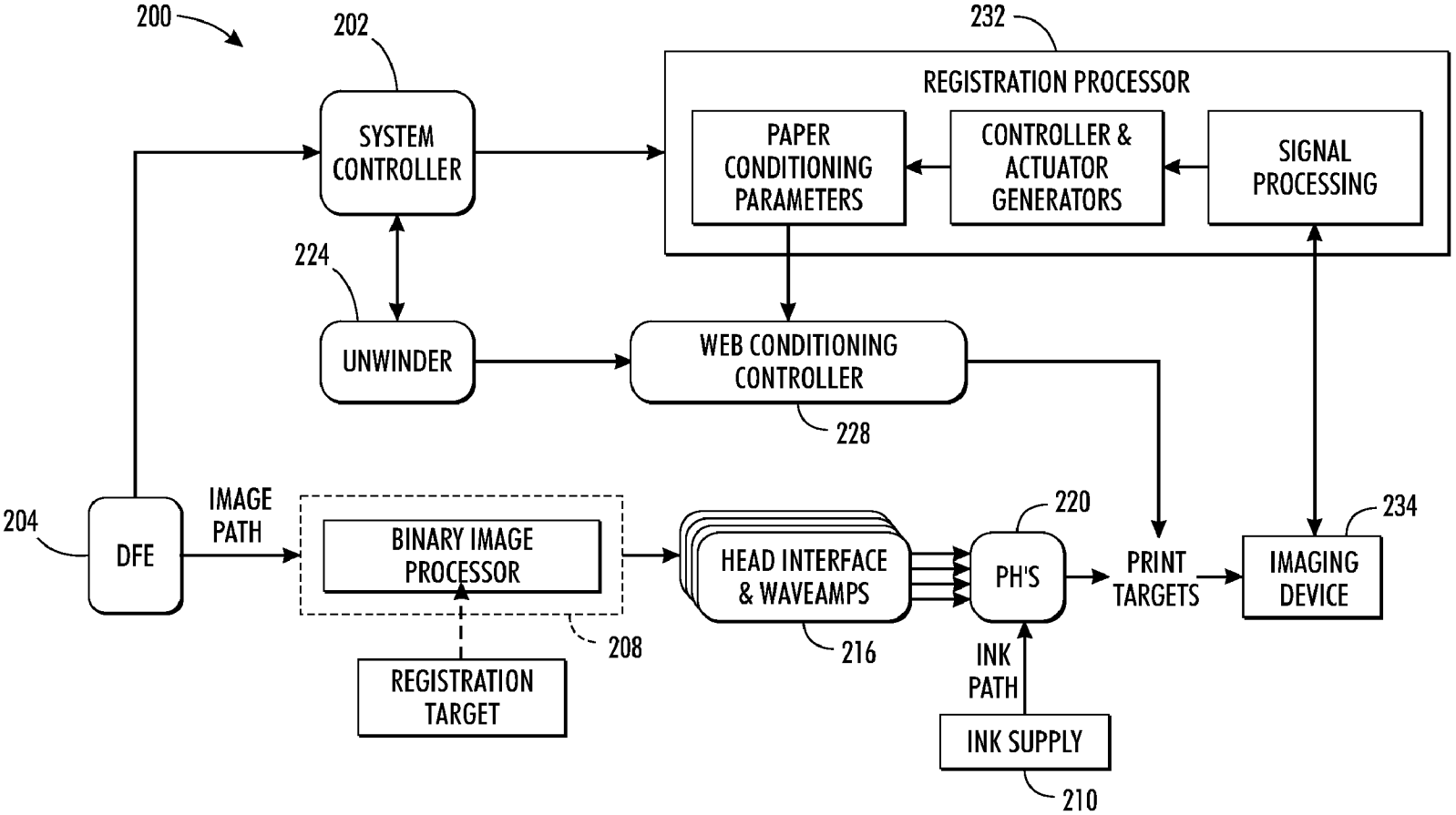
FIG. 2 is a block diagram of a web printing system that identifies dimensional changes in a web and changes the operation of components in the web printing system to compensate for dimensional changes that exceed predetermined thresholds.

To address misregistration that may arise from dimensional changes in a web moving through a web printing system, a method and system have been developed that measure the cross-process dimensional change in the web caused by exposure of the web to heat along the web path and change the operation of one or more components in the web printing system to compensate for the measured web shrinkage. For example, detection of web shrinkage may result in one or more components in a web conditioning unit being operated at a higher temperature to drive water out of the web and shrink the web before the web reaches the print zone. In this manner, the web is pre-shrunk before printing and the web is unable to shrink sufficiently to be detectable visually. Once appropriate web conditioning parameters are identified and used, the web shrinkage is not likely to change and the method and system may be performed weekly or daily. The system and method may also or alternatively be performed at media roll changes, at the start of a job run, or during a job. The system 200 is shown in block diagram form in FIG. 2. As depicted in that figure, the web printing system 200 includes a system controller 202, a digital front end (DFE) 204, a binary image processor 208, the printhead interface and waveform amplifier boards 216, a plurality of printheads 220, an unwinder controller 224, a web condition controller 228, a registration controller 232, and a web imaging device 234.

In more detail, the system controller 202 receives control information for operating the web printing system from a digital front end (DFE) 204. During a job, image data to be printed are also provided by the DFE to the web printing system components that operate the printheads to eject ink onto the web and form ink images that correspond to the images provided by the DFE. These components include the binary image processor 208, and the printhead interface and waveform amplifier boards 216. The binary processor 208 performs binary imaging processes, such as process direction norming. Each printhead interface and waveform amplifier board 216 generates the firing signals that operate the inkjet ejectors in the printheads 220 that are electrically coupled to one of the boards 216. Registration and color control are provided by the registration controller 232 to adjust inkjet timing and printhead position. The imaging device 234 provides the registration controller 232 with image data of the web at a predetermined position along the web path through the web printing system. The registration controller performs signal processing on the image data received from the imaging device to determine the timing and printhead movement adjustments required for the printing process. In the embodiments that also adjust web conditioning, the temperature and/or other operational parameters of components driving the web through the system are also determined and provided to the web condition controller 228. The web condition controller generates the control signals to alter the operation of the actuators and heaters that condition the web for printing. As used in this document, "web conditioning unit" refers to any component that is positioned along the web path to affect some aspect of the web, such as the temperature, cleanliness, water content, or surface conditions of the web. Such units include heated rollers, blowers, and the like.

The controllers used in the system 200 include memory storage for data and programmed instructions. The controllers may be implemented with general or specialized programmable processors that execute programmed instructions. The instructions and data required to perform the programmed functions may be stored in memory associated with each controller. The programmed instructions, memories, and interface circuitry configure the controller to perform the functions described above. These controllers may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Figure 3:
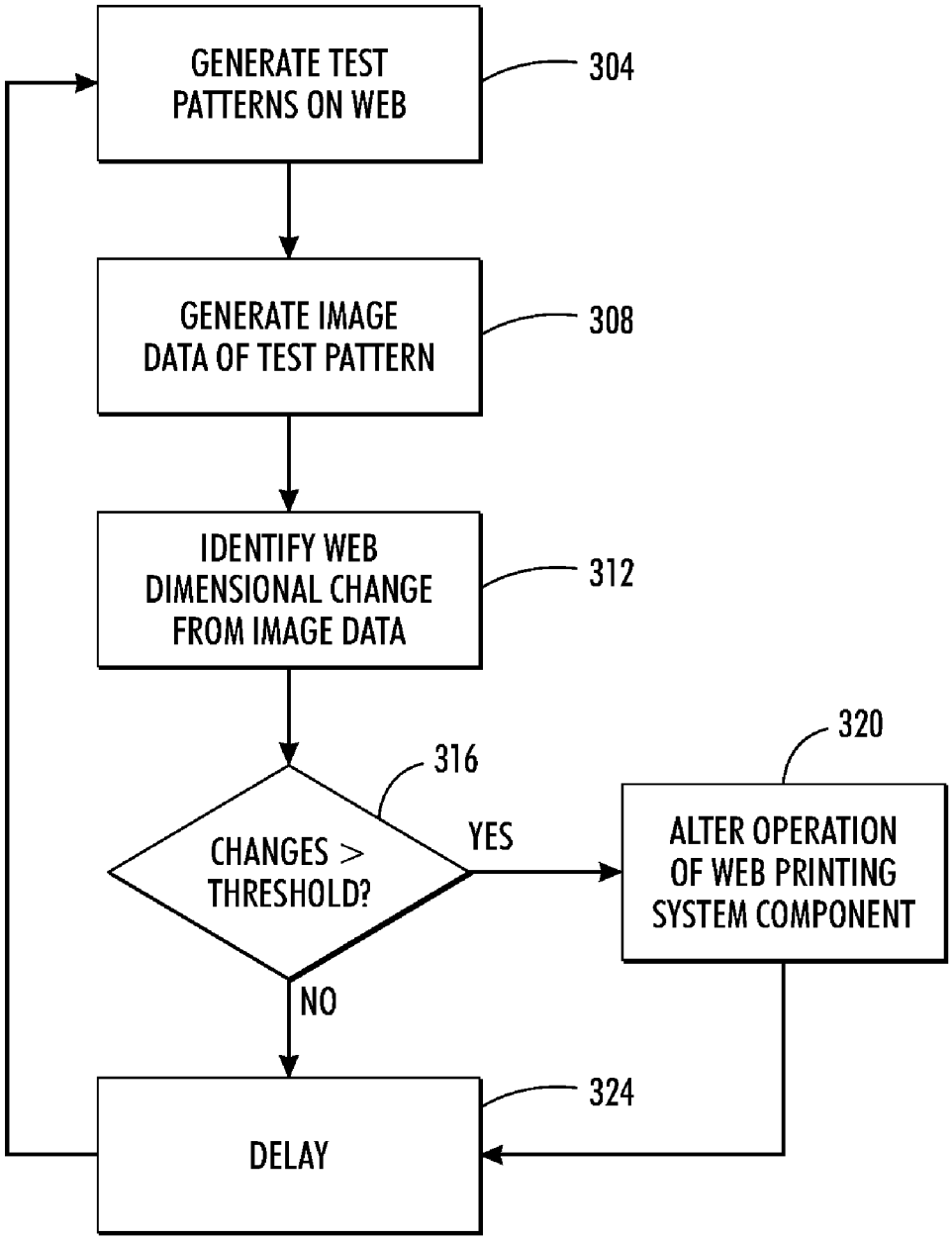
FIG. 3 is a flow diagram of a process that may be implemented by one or more controllers operating in the web printing system of FIG. 2.

A method of identifying dimensional changes in a web as it travels through a web printing system and of changing operation of web printing system components in response to the identified dimensional changes exceeding a predetermined threshold is shown in FIG. 3. The method 300 begins by generating test patterns on the web (block 304). The test patterns are generated by supplying registration pattern data from a memory to the binary image processor 212 for processing and delivery to the printhead interface and waveform amplifier boards 216. The firing signals from the printhead interface and waveform amplifier boards operate printheads to eject ink onto the web to form the test pattern. When the test pattern passes by the imaging device 234, image data of the test pattern is generated (block 308) and processed to identify dimensional changes in the web (block 312). Although changes in dimensions in both process and cross-process direction may be identified, the process shown in FIG. 3 processes the image data of the test pattern to identify dimensional changes in the cross-process direction. The identified dimensional changes in the cross-process direction are compared to a predetermined threshold (block 316). If the identified dimensional change in the cross-process direction exceeds the threshold, operation of a web printing system component is changed to compensate for the dimensional change (block 320). The operational changes include, but are not limited to, changing a temperature set point used to regulate a heated roller or activating/deactivating a blower or adjusting the temperature set point at which heater or chiller for air flow or other fluids used to condition a web. The method of FIG. 3 may be repeated after some period of time elapses to enable the web conditioning to stabilize and verify the web dimensions are within the threshold.

Figure 4:
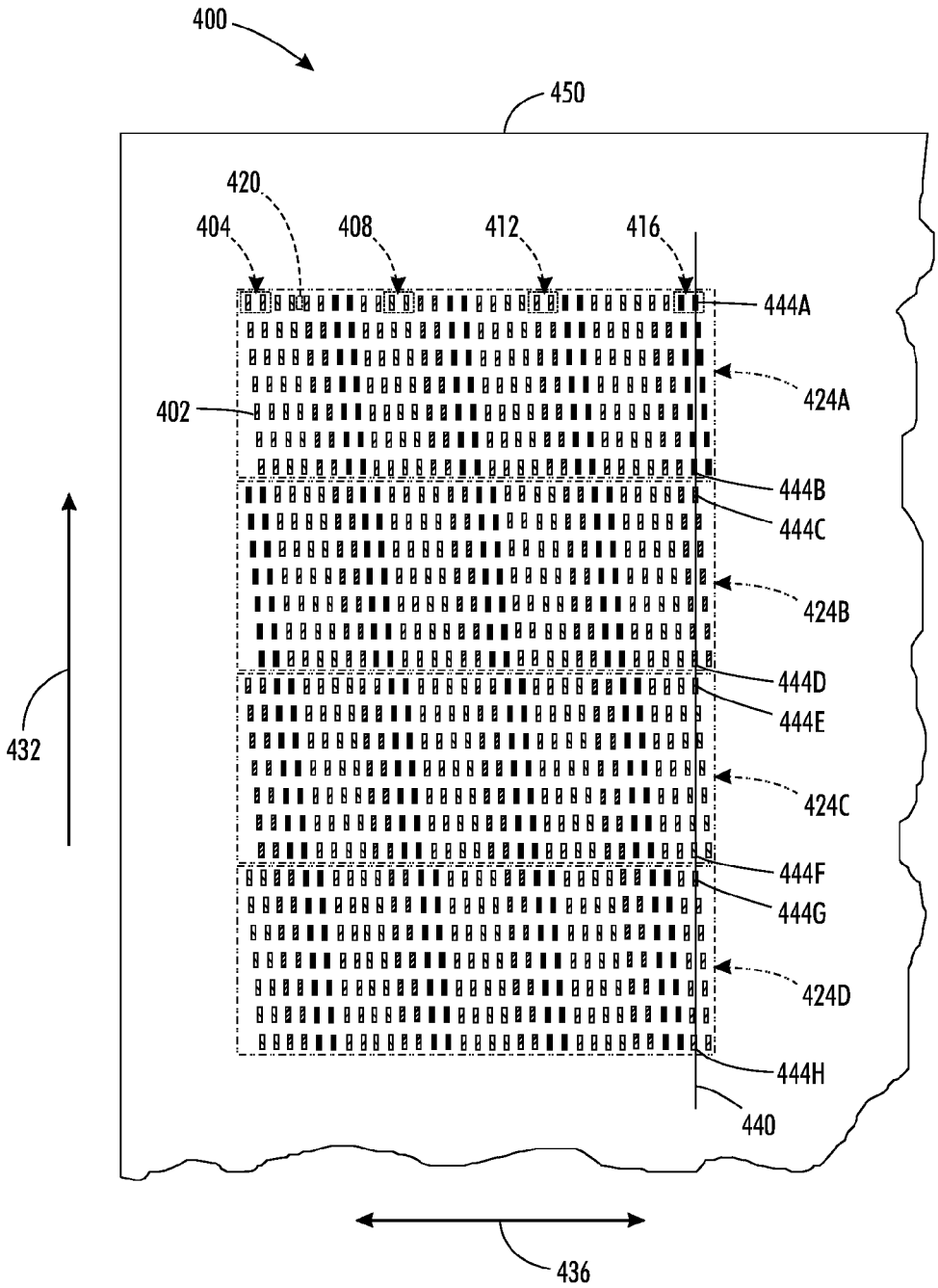
FIG. 4 is an illustration of a test pattern that may be used to detect dimensional changes in a cross-process direction as the web passes through a print zone.

An example of a test pattern that may be printed to evaluate web shrinkage in a cross-process direction is shown in FIG. 4. Test pattern 400 includes a plurality of dashes, where each dash is formed from ink ejected from a single inkjet ejector in a printhead. The dashes 402 are formed in the print process direction 432, with multiple rows of dashes disposed along the cross-process axis 436. Test pattern 400 is configured for use with a printer using cyan, magenta, yellow, and black (CMYK) coloring stations. Test pattern 400 is further configured for use with ink coloring stations configured for interlaced printing using two printhead arrays for each of the CMYK colors. Dashes of the same color, one from each of the aligned printheads in each coloring station, are spaced adjacent to one another in each row of test pattern 400, as seen with cyan dashes 404, magenta dashes 408, yellow dashes 412, and black dashes 416. In FIG. 4, the dashes in each row of test pattern 400 are arranged in a ladder including seven (7) inkjet ejectors, such that one inkjet ejector in the inkjet printhead forms a dash, and the next dash in the row comes from an inkjet ejector that is offset by six (6) positions in the cross-process axis 436. The space 420 between consecutive dashes in a row of test pattern 400 is the width of the six non-printing inkjet ejectors. Alternative test patterns could employ ladders with a larger or smaller number of inkjet ejectors in each group producing a similar test pattern having multiple rows of dashes.

The length of the dashes 402 corresponds to the number of drops used to form a dash. The number of drops is chosen to produce a dash that is sufficiently greater in length than the resolution of an optical detector in the process direction. The distance imaged by an optical detector is dependent upon the speed of the image member moving past the detector and the line rate of the optical detector. A single row of optical detectors extending across the width of the imaging area on the image receiving member is called a scanline in this document. The dashes are generated with a length that is greater than a single scanline in the process direction so the dash image can be resolved in the image processing. Thus, multiple scanlines are required to image the entire length of the dashes in the process direction.

The method to measure paper shrinkage affecting registration in the cross-process direction includes analyzing images of the dashes captured by the imaging device 234 to extract relative pixel positions for drops ejected by different printheads (e.g., magenta and black). Subsets of nozzles on different printheads are used to print dashes of different colors that are a single pixel wide. For example, the test pattern shown in FIG. 4 enables a dash to be printed from every nozzle in a configuration of printheads, such as the one shown in FIG. 5. The images of the dashes are processed to determine the centers of the dashes. This image analysis is able to identify the position of all the nozzles on the printhead. The difference in the spacing between the leftmost and rightmost nozzle on the print head indicates the paper width at the time the image was captured with the imaging device 234. If this spacing varies for printheads at different positions in the web path, then cross-direction paper shrinkage has occurred. Methods for analyzing images of dashes in a test pattern to identify the process and cross-process positions of the dashes and their centers are disclosed in co-pending patent applications entitled "Test Pattern Effective For Coarse Registration Of Inkjet Printheads And Method Of Analysis Of Image Data Corresponding To The Test Pattern In An Inkjet Printer" having Ser. No. 12/754,730, which was filed on even date herewith and "Test Pattern Effective For Fine Registration Of Inkjet Printheads And Method Of Analysis Of Image Data Corresponding To The Test Pattern In An Inkjet Printer" having Ser. No. 12/754,735, which was filed on even date herewith, both of which are commonly owned by the assignee of the present invention. The disclosures of both of these applications are hereby expressly incorporated by reference in their entireties in this application.

The predetermined thresholds are empirically determined to establish the amount of shrinkage that affects image quality. If a dimensional change in the cross-process direction exceeds the threshold, then the web has shrunk in the cross-process direction by an amount since the pattern was printed that is likely to affect image quality. The controller may change operation of a web printing component to drive more moisture out of the web before it is printed so it shrinks less thereafter. The changes in web printing components may include, for example, changes in the temperature at which one or more components, such as rollers, operate. For example, a temperature set point for a heated roller in the web conditioning unit may be increased to increase the heat in the roller and enable the heated roller to heat the web and evaporate more moisture from the web. If more moisture in the web was desirable, then the heat of the roller could be decreased to reduce the amount of heat to which the web is exposed by the roller.

Figure 5:
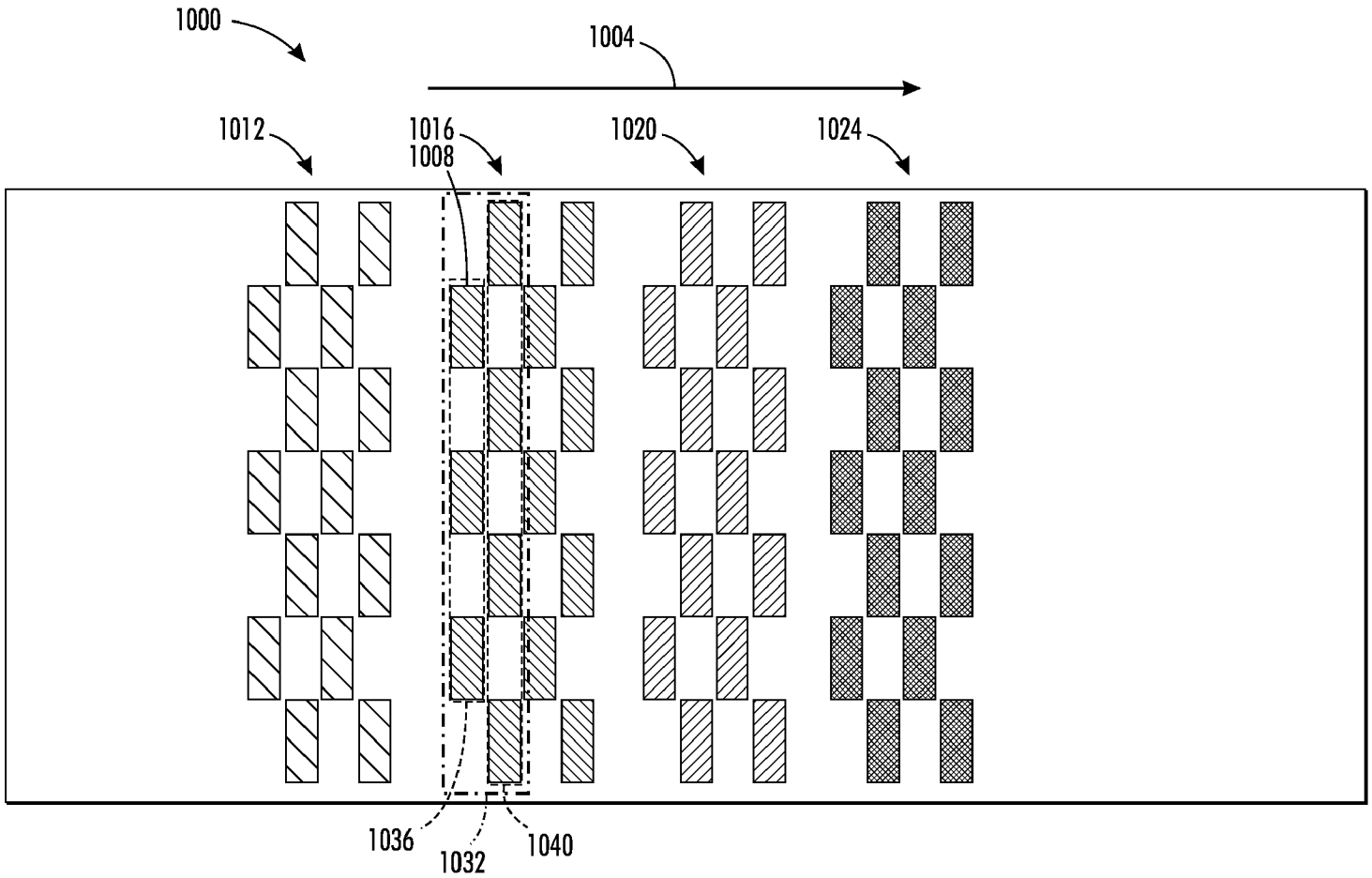
FIG. 5 PRIOR ART
FIG. 5 is an illustration of a printhead configuration that defines a print zone.
Figure 6:
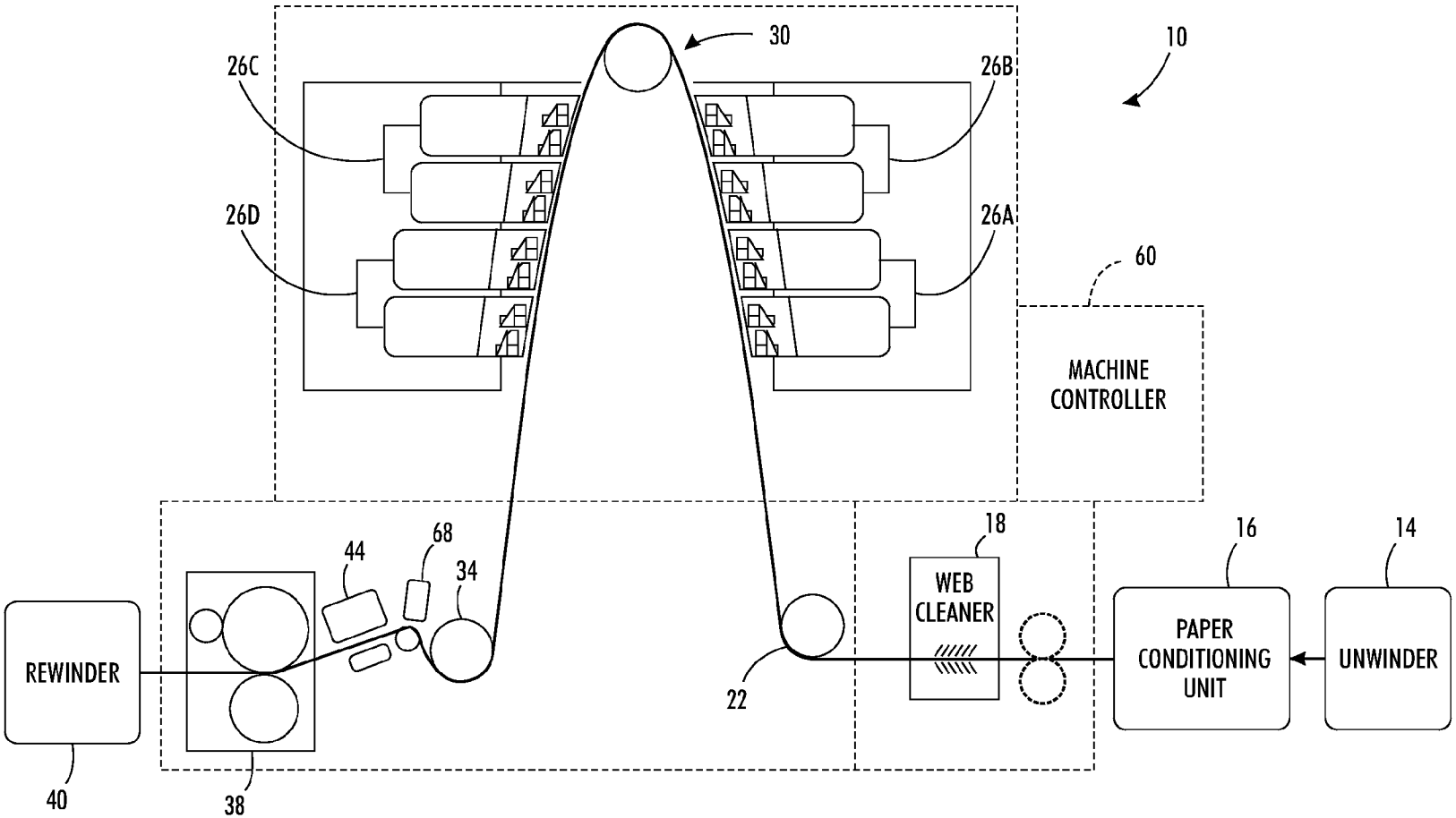
FIG. 6 is a block diagram of a double reflex web printing system.

An example of a printhead arrangement that may be used to detect web shrinkage as the web passes through the print zone defined by the printheads is shown in FIG. 5. The print zone 1000 includes four color units 1012, 1016, 1020, and 1024 arranged along a process direction 1004. Each color unit ejects ink of a color that is different than the other color units. In one embodiment, color unit 1012 ejects cyan ink, color unit 1016 ejects magenta ink, color unit 1020 ejects yellow ink, and color unit 1024 ejects black ink. The process direction is the direction that an image receiving member moves as travels under the color unit from color unit 1012 to color unit 1024. Each color unit includes two print arrays, which include two print bars each that carry multiple printheads. For example, the printhead array 1032 of the magenta color unit 1016 includes two print bars 1036 and 1040. Each print bar carries a plurality of printheads, as exemplified by printhead 1008. Print bar 1036 has three printheads, while print bar 1040 has four printheads, but alternative print bars may employ a greater or lesser number of printheads. The printheads on the print bars within a print array, such as the printheads on the print bars 1036 and 1040, are staggered to provide printing across the image receiving member at a first resolution. The printheads on the print bars with the print array 1034 within color unit 1016 are interlaced with reference to the printheads in the print array 1032 to enable printing in the colored ink across the image receiving member in the cross-process direction at a second resolution. The print bars and print arrays of each color unit are arranged in this manner. One printhead array in each color unit is aligned with one of the printhead arrays in each of the other color units. The other printhead arrays in the color units are similarly aligned with one another. Thus, the aligned printhead arrays enable drop-on-drop printing of different primary colors to produce secondary colors. The interlaced printheads also enable side-by-side ink drops of different colors to extend the color gamut and hues available with the printer.

In operation, the system determines if web shrinkage is acceptable by printing registration patterns and generating images of the printed web with the web imaging device. The image data for the patterns are processed to determine the magnitude of the web shrinkage and if the magnitude exceeds the empirically determined thresholds, the operation of one or more web printing system components is changed. The shrinkage may be continually monitored through a run by printing dashes in inter-document zones on the web. Inter-document zones are areas between document areas where the print job images are printed. The patterns printed in the inter-document zones may be cut out during finishing of the printed web.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating a web printing system comprising:

operating at least one printhead that ejects a first color of ink to form a first predetermined pattern on the web in the first ink color;

operating at least one other printhead that ejects a color of ink that is different than the first ink color to form a second predetermined pattern on the web in the different ink color after the web has traveled in a process direction to a position opposite the at least one other printhead;

generating image data corresponding to the first predetermined pattern of ink on the web and to the second predetermined pattern of ink on the web;

identifying a cross-process dimensional change in a web moving through the web printing system from spatial differences in the generated image data between the first predetermined pattern and the second predetermined pattern;

comparing the identified cross-process dimensional change to a predetermined threshold; and changing operation of a component in the web printing system to compensate for the cross-process dimensional change in the web that occurred after the web traveled from the at least one printhead to the at least one other printhead in response to the identified cross-process dimensional change in the web exceeding the predetermined threshold.

2. The method of claim 1, the operation change further comprising:

changing an operational parameter for a web conditioning unit.

3. The method of claim 2, the changing of the operational parameter further comprising:

changing a temperature set point used to regulate a temperature of a heated roller in the web printing system.

4. The method of claim 1, the operation of the printheads further comprising:

operating the at least one printhead and the at least one other printhead to eject ink onto an inter-document area of the web to form the first predetermined pattern and the second predetermined pattern.

5. A web printing system comprising:

an imaging device to generate image data of a web passing by the imaging device; and a controller associated with the web printing system, the controller being configured to:

operate a first group of printheads in a plurality of printheads to eject a first color of ink to form a first predetermined pattern on the web in the first ink color;

operate a second group of printheads in the plurality of printheads to eject a color of ink that is different than the first ink color to form a second predetermined pattern on the web in the different ink color, the second group of printheads being positioned in the web printing system to enable the second group of printheads to eject ink of the color that is different than the first ink color onto the web after the web has traveled in a process direction from the first group of printheads to the second group of printheads;

measure a cross-process dimensional change in the web from spatial differences between the first predetermined pattern and the second predetermined pattern in the image data generated by the imaging device; and change operation of a component in the web printing system to compensate for the cross-process dimensional change in the web that occurred after the web traveled in the process direction from the first group of printheads to the second group of printheads in response to the measured cross-process dimensional change in the web exceeding a predetermined threshold.

6. The web printing system of claim 5 further comprising:

a web conditioning unit; and the controller is further configured to change operation of the web conditioning unit in response to the measured cross-process dimensional change exceeding a predetermined threshold.

7. The web printing system of claim 6, the controller being configured to change a temperature at which a heated roller in the web conditioning unit is maintained in response to the measured cross-process dimensional change exceeding the predetermined threshold.

8. The web printing system of claim 6, the controller being configured to change an operational status of a blower in the web conditioning unit in response to the measured cross-process dimensional change exceeding the predetermined threshold.

9. The web printing system of claim 6, the controller being configured to change an operational status of a heater in the web conditioning unit in response to the measured cross-process dimensional change exceeding the predetermined threshold.

10. The web printing system of claim 6, the controller being configured to change an operational status of a chiller in the web conditioning unit in response to the measured cross-process dimensional change exceeding the predetermined threshold.

* * * * *